US011255587B2

(12) United States Patent
Matsuda et al.

(10) Patent No.: US 11,255,587 B2
(45) Date of Patent: Feb. 22, 2022

(54) OIL SEPARATOR AND AIR CONDITIONER INCLUDING THE SAME

(71) Applicant: Mitsubishi Electric Corporation, Tokyo (JP)

(72) Inventors: Hirofumi Matsuda, Tokyo (JP); Hiroki Ishiyama, Tokyo (JP); Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 152 days.

(21) Appl. No.: 16/651,073

(22) PCT Filed: Sep. 28, 2017

(86) PCT No.: PCT/JP2017/035219
§ 371 (c)(1),
(2) Date: Mar. 26, 2020

(87) PCT Pub. No.: WO2019/064427
PCT Pub. Date: Apr. 4, 2019

(65) Prior Publication Data
US 2020/0248941 A1 Aug. 6, 2020

(51) Int. Cl.
*F25B 43/02* (2006.01)

(52) U.S. Cl.
CPC ..... *F25B 43/02* (2013.01); *F25B 2400/02* (2013.01)

(58) Field of Classification Search
CPC ..... F25B 43/02; F25B 43/006; F25B 31/004; F25B 31/002; F25B 2400/02;
(Continued)

(56) References Cited

U.S. PATENT DOCUMENTS

2008/0006011 A1* 1/2008 Larnholm ..... B01D 21/265 55/421
2017/0276415 A1* 9/2017 Ishiyama ..... F25B 43/02

FOREIGN PATENT DOCUMENTS

CN 205279549 U 6/2016
CN 206503217 U 9/2017
JP 2009-174836 A 8/2009

OTHER PUBLICATIONS

International Search Report of the International Searching Authority dated Dec. 19, 2017 for the corresponding International application No. PCT/JP2017/035219 (and English translation).
(Continued)

*Primary Examiner* — Len Tran
*Assistant Examiner* — Kamran Tavakoldavani
(74) *Attorney, Agent, or Firm* — Posz Law Group, PLC

(57) ABSTRACT

An oil separator includes a separation container. The separation container has a side surface portion to which an inlet pipe is attached. The separation container has an upper surface portion to which an outlet pipe is attached. An oil reservoir is provided in a lower portion of the separation container. The separation container has a lower surface portion to which an oil return pipe is attached. The separation container has an inner wall surface provided with a liquid passage section. The liquid passage section is provided with a groove. The groove is disposed to extend in a direction of gravity toward the oil reservoir. The groove is formed to be gradually increased in depth from an upper portion of the groove toward a lower portion thereof.

14 Claims, 23 Drawing Sheets

(58) Field of Classification Search
CPC ..... F25B 2400/23; F25B 2500/01; F25B 2500/17; F28F 5/00; B01D 45/12; B01D 45/14; B01D 45/16; B04B 5/005; B04B 5/12; B04B 2005/125; B04C 2003/006
See application file for complete search history.

(56) References Cited

OTHER PUBLICATIONS

Chinese Office Action dated Apr. 1, 2021, issued in corresponding CN Patent Application No. 201780095044.9 (and English Machine Translation).

* cited by examiner

OIL SEPARATOR AND AIR CONDITIONER INCLUDING THE SAME

CROSS REFERENCE TO RELATED APPLICATION

This application is a U.S. national stage application of International Application PCT/JP2017/035219 filed on Sep. 28, 2017, the contents of which are incorporated herein by reference.

TECHNICAL FIELD

The present invention relates to an oil separator and an air conditioner including the oil separator, and particularly to an oil separator that separates oil contained in refrigerant, and an air conditioner including the oil separator.

BACKGROUND

An air conditioning apparatus includes an oil separator used for separating, from refrigerant, the oil (refrigeration oil) discharged together with the refrigerant from a compressor so as to return the separated oil to the compressor. In order to ensure the reliability of the compressor and improve the performance of the refrigeration cycle, the oil separator is required to efficiently separate the refrigeration oil from the refrigerant.

Conventionally, there has been a cyclone-type oil separator as an example of an oil separator. It is important for the oil separator of this type as to how efficiently refrigeration oil is separated by utilizing centrifugal force. Furthermore, in order to efficiently separate refrigeration oil, it is also important for the oil separator to prevent a phenomenon in which the separated refrigeration oil is stirred up by refrigerant and dispersed again so as to flow together with the refrigerant.

In recent years, downsizing of the oil separator has been required. In accordance with downsizing of the oil separator, the influence exerted by re-dispersion of the refrigeration oil is increased accordingly. Also, at a relatively high flow rate of the discharged refrigerant, the influence exerted by re-dispersion of the refrigeration oil is increased accordingly. For example, PTL 1 proposes an oil separator for solving such problems.

PATENT LITERATURE

PTL 1: Japanese Patent Laying-Open No. 2009-174836

In a system in which refrigeration oil is separated from refrigerant by an oil separator, in the case where the oil separator is relatively small in size or in the case where the refrigerant flows at a relatively high flow rate into the oil separator, the influence of contact of the refrigerant with the refrigeration oil separated in the oil separator is increased. Thus, the separated refrigeration oil disperses again, and flows together with the refrigerant through a refrigerant pipe, with the result that the efficiency in separating the refrigeration oil from the refrigerant is decreased.

SUMMARY

The present invention has been made in order to solve the above-described problems. An object of the present invention is to provide an oil separator for efficiently separating refrigeration oil from refrigerant while suppressing re-dispersion of the separated refrigeration oil. Another object of the present invention is to provide an air conditioner including the oil separator.

One oil separator according to the present invention serves as an oil separator for separating refrigeration oil contained in refrigerant from the refrigerant, and includes a separation container, an inlet pipe, an outlet pipe, an oil reservoir, a liquid passage section, and an oil return pipe. The separation container forms a separation chamber. The inlet pipe of the refrigerant communicates with the separation container. The outlet pipe of the refrigerant communicates with the separation container. The oil reservoir is provided in the separation container and configured to store the refrigeration oil. The liquid passage section provided with a groove is disposed inside the separation container and configured to guide the refrigeration oil contained in the refrigerant to the oil reservoir. The oil return pipe is attached to the separation container and communicates with the oil reservoir. The liquid passage section has the groove that is formed to be gradually increased in depth from an upper portion of the groove toward a lower portion of the groove.

Another oil separator according to the present invention serves as an oil separator for separating refrigeration oil contained in refrigerant from the refrigerant, and includes a separation container, an inlet pipe, an outlet pipe, an impeller section, a liquid passage section, an oil reservoir, and an oil return pipe. The separation container forms a separation chamber. The inlet pipe of the refrigerant communicates with the separation container. The outlet pipe of the refrigerant communicates with the separation container. The impeller section is provided inside the separation container and has a vane configured to rotate by a flow of the refrigerant that is supplied from the inlet pipe. The liquid passage section is provided in the vane and provided with a groove through which the refrigeration oil contained in the refrigerant is guided. The oil reservoir is provided in the separation container and configured to store the refrigeration oil. The oil return pipe is attached to the separation container and communicates with the oil reservoir. The groove is provided on a wall surface of the vane so as to extend from a rotation center side of the vane toward an outer circumferential end of the vane.

An air conditioner according to the present invention serves as an air conditioner including the above-mentioned one oil separator or another oil separator, and includes a compressor, an oil separator, a condenser, an expansion valve, and an evaporator that are connected sequentially in series by a refrigerant pipe. The refrigerant pipe has the inlet pipe and the outlet pipe. The inlet pipe connects a discharge side of the compressor and the oil separator. The outlet pipe connects the oil separator and the condenser. The oil return pipe connects the oil separator and a suction side of the compressor.

According to one oil separator in the present invention, refrigeration oil contained in refrigerant is received in a groove formed to be gradually increased in depth from an upper portion of the groove toward a lower portion thereof. Thereby, re-dispersion of the refrigeration oil by the refrigerant and the like can be prevented, with the result that the efficiency in separating the refrigeration oil contained in the refrigerant can be enhanced while the separated refrigeration oil can be returned to a compressor.

According to another oil separator in the present invention, when refrigerant and the like flow along a vane, the refrigeration oil contained in the refrigerant is received in a groove formed in the vane. Thereby, re-dispersion of the refrigeration oil by the refrigerant and the like can be prevented, with the result that the efficiency in separating the refrigeration oil contained in the refrigerant can be enhanced while the separated refrigeration oil can be returned to a compressor.

According to an air conditioner in the present invention, by applying the above-mentioned one oil separator or another oil separator, the efficiency in separating the refrigeration oil contained in the refrigerant can be enhanced while the separated refrigeration oil can be returned to a compressor.

DETAILED DESCRIPTION

Figure 1:
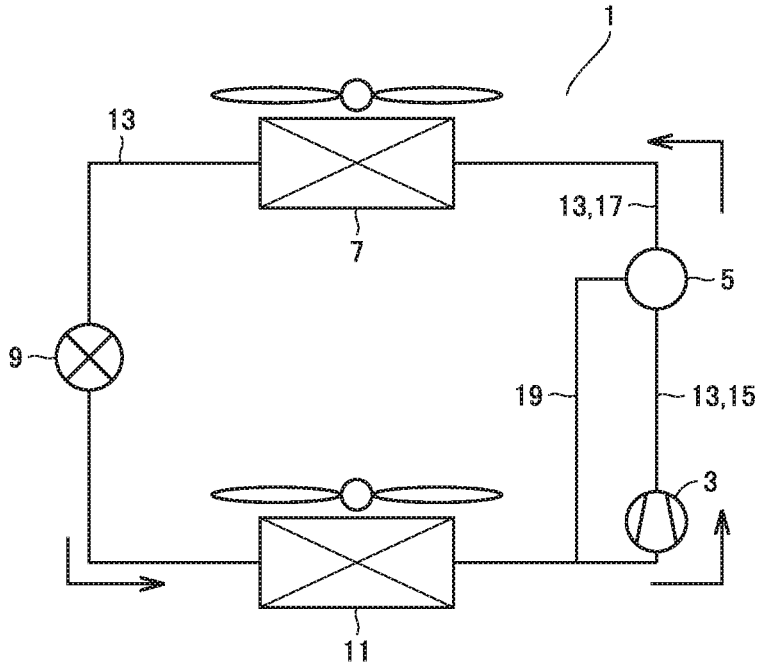
FIG. 1 is a diagram showing a refrigerant circuit of an air conditioner to which an oil separator according to each embodiment is applied.

First, an example of an air conditioner to which an oil separator is applied will be hereinafter described. As shown in FIG. 1, in an air conditioner 1, a refrigerant circuit is formed by sequentially connecting a compressor 3, an oil separator 5, a condenser 7, an expansion valve 9, and an evaporator 11 through a refrigerant pipe 13. The refrigerant is compressed by compressor 3 and turns into high-temperature and high-pressure gas refrigerant, which is then discharged from compressor 3. The discharged high-temperature and high-pressure gas refrigerant is conveyed through oil separator 5 to condenser 7. In condenser 7, heat exchange is performed between the incoming refrigerant and the air supplied into condenser 7. By heat exchange, the high-temperature and high-pressure gas refrigerant is condensed and turns into high-pressure liquid refrigerant.

By expansion valve 9, the high-pressure liquid refrigerant supplied from condenser 7 is turned into refrigerant in a two-phase state including low-pressure gas refrigerant and liquid refrigerant. The refrigerant in a two-phase state flows into evaporator 11. In evaporator 11, heat exchange is performed between the incoming refrigerant in a two-phase state and the air supplied into evaporator 11. By this heat exchange, the liquid refrigerant evaporates and turns into low-pressure gas refrigerant.

The low-pressure gas refrigerant supplied from evaporator 11 flows into compressor 3, in which the low-pressure gas refrigerant is compressed into high-temperature and high-pressure gas refrigerant. The high-temperature and high-pressure gas refrigerant is again discharged from compressor 3 and conveyed through oil separator 5 to condenser 7. This cycle is repeated thereafter.

In air conditioner 1, the refrigeration oil contained in the refrigerant discharged from compressor 3 is separated from the refrigerant in oil separator 5. The separated refrigeration oil is to flow through an oil return pipe 19 so as to be returned to the suction side of compressor 3.

The following is an explanation about a specific structure of oil separator 5 used in air conditioner 1 in each embodiment.

First Embodiment

Figure 2:
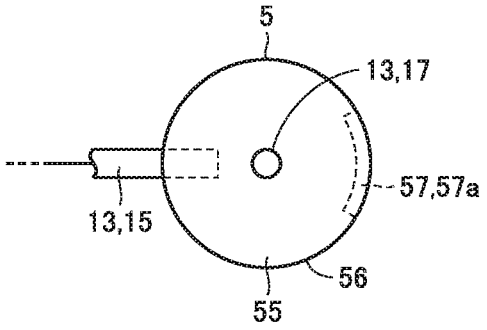
FIG. 2 is a top view of an oil separator according to the first embodiment.
Figure 3:
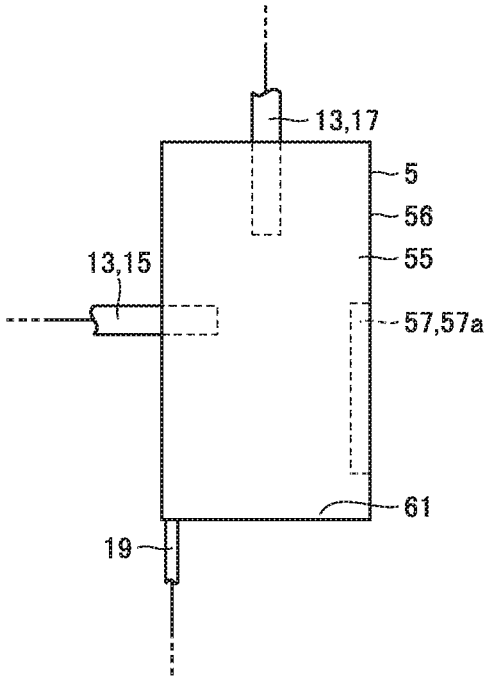
FIG. 3 is a side view of the oil separator in the first embodiment.

Oil separator 5 according to the first embodiment will be hereinafter described. As shown in FIGS. 2 and 3, oil separator 5 includes a separation container 56 that forms a separation chamber 55. In consideration of productivity, separation container 56 is formed in an approximately circular cylindrical shape. Separation container 56 has a side surface portion to which an inlet pipe 15 is attached as a part of refrigerant pipe 13. Inlet pipe 15 is attached so as to extend in the direction approximately orthogonal to the tangential direction of the side surface portion of separation container 56. Inlet pipe 15 connects the discharge side of compressor 3 and oil separator 5 (separation container 56).

Separation container 56 has an upper surface portion to which an outlet pipe 17 is attached as a part of refrigerant pipe 13. Outlet pipe 17 connects oil separator 5 (separation container 56) and condenser 7. In a lower portion of separation container 56, an oil reservoir 61 is provided. Separation container 56 has a lower surface portion to which oil return pipe 19 is attached. Oil return pipe 19 connects oil reservoir 61 and the suction side of compressor 3.

Figure 4:
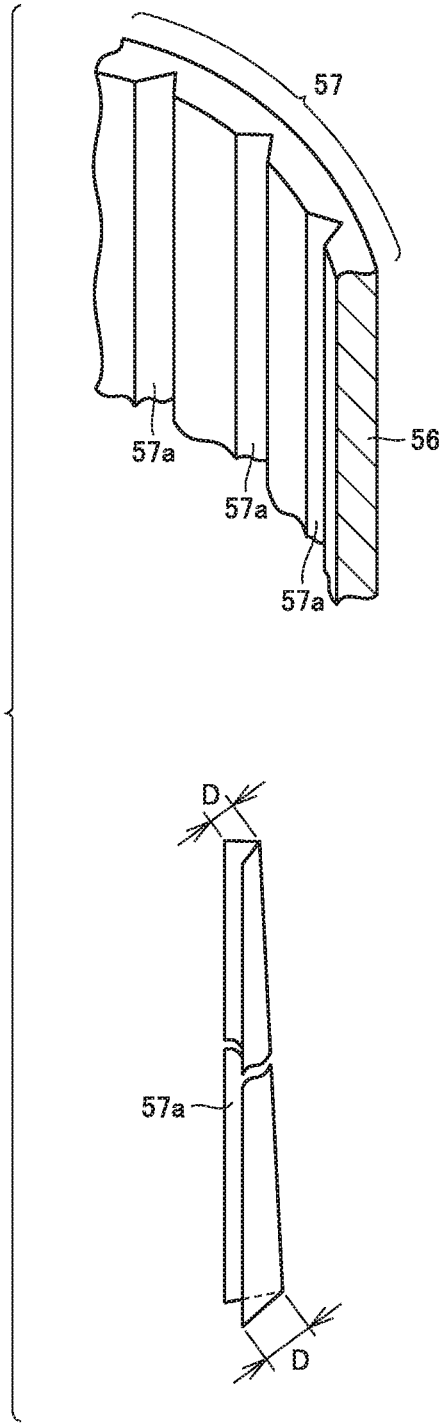
FIG. 4 is a partial enlarged perspective cross-sectional view showing a liquid passage section in the first embodiment.

As shown in FIG. 4, separation container 56 has an inner wall surface provided with a liquid passage section 57 serving as a flow passage of refrigeration oil. Liquid passage section 57 is disposed to include a region facing the outlet port of inlet pipe 15. Liquid passage section 57 is provided with a groove 57*a*. In this case, groove 57*a* is disposed to extend in the direction of gravity toward oil reservoir 61. As shown in a lower partial view in FIG. 4, groove 57*a* is formed to have a depth D that is gradually increased from an upper portion of groove 57*a* toward a lower portion thereof. In other words, groove 57*a* is formed to be gradually increased in depth from the upstream side of the flow of the refrigeration oil toward the downstream side thereof.

Figure 5:
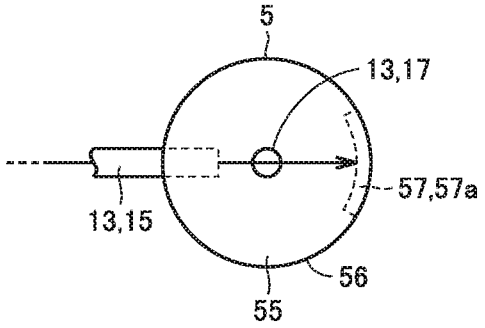
FIG. 5 is a top view of the oil separator for illustrating the operation of the oil separator in the first embodiment.
Figure 6:
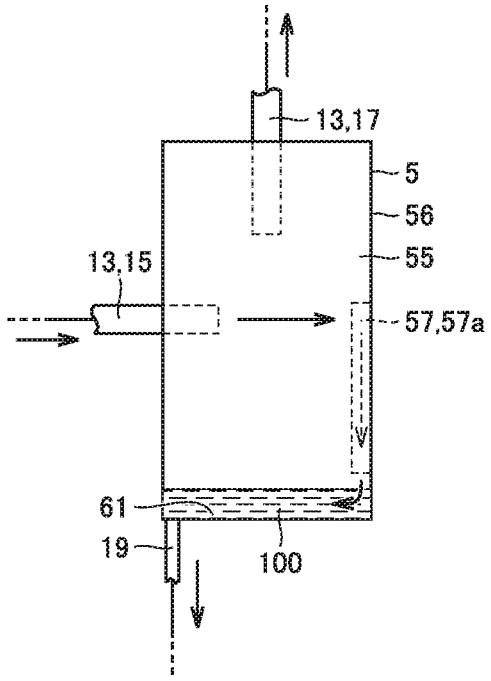
FIG. 6 is a side view of the oil separator for illustrating the operation of the oil separator in the first embodiment.

The following is an explanation about the operation by the above-mentioned oil separator 5 for separating the refrigeration oil contained in the refrigerant. As shown in FIGS. 5 and 6, by the operation of air conditioner 1, the high-temperature and high-pressure refrigerant discharged from compressor 3 flows through inlet pipe 15 into oil separator 5. The refrigerant contains refrigeration oil of compressor 3. The refrigerant containing refrigeration oil is discharged through inlet pipe 15 into separation container 56. Then, the refrigeration oil contained in the refrigerant is received in groove 57*a* of liquid passage section 57, thereby separating the refrigerant from the refrigeration oil. The refrigerant separated from the refrigeration oil flows through outlet pipe 17 so as to be fed into condenser 7 (see FIG. 1) as indicated by an arrow.

On the other hand, the refrigeration oil received in groove 57*a* flows by gravity through groove 57*a* so as to be fed into oil reservoir 61 as indicated by an arrow. Refrigeration oil 100 accumulated in oil reservoir 61 flows into oil return pipe 19. As shown in FIG. 1, the refrigeration oil having flowed through oil return pipe 19 is fed into the suction side of compressor 3. In this way, the refrigeration oil discharged together with the refrigerant is returned to compressor 3. This operation is to be repeated thereafter while air conditioner 1 is operating.

In oil separator 5 of air conditioner 1 as described above, groove 57*a* formed in liquid passage section 57 and receiving the refrigeration oil contained in the refrigerant is disposed to extend toward oil reservoir 61 in the direction of gravity. Also, groove 57*a* is formed to be gradually increased in depth from its upper portion toward its lower portion.

Thus, the area of contact between the refrigeration oil and groove 57*a* is to increase from the upper portion of groove 57*a* toward the lower portion thereof. This means that the interfacial energy represented by the product of the area of contact and the surface tension gradually becomes larger in the negative direction from the upper portion of groove 57*a* toward the lower portion thereof. In other words, it means that the interfacial energy decreases.

Thus, by the action of gravity, the refrigeration oil flows actively through groove 57*a* toward the lower portion of groove 57*a* at which the interfacial energy is smaller, so that the refrigeration oil is introduced into oil reservoir 61. When the refrigeration oil actively flows through groove 57*a*, accumulation of the refrigeration oil in groove 57*a* can be suppressed while re-dispersion of the refrigeration oil by the refrigerant discharged from inlet pipe 15 can be prevented. As a result, the efficiency in separating the refrigeration oil contained in the refrigerant can be enhanced while the separated refrigeration oil can be returned to the compressor.

In order to reliably receive the refrigeration oil in groove 57*a*, it is desirable that the position of the outlet port of inlet pipe 15 is located at the same height as the position at which groove 57*a* is started in liquid passage section 57. Furthermore, liquid passage section 57 may be formed in a range at least in the circumference portion of the length corresponding to the radius of inlet pipe 15 on the side wall surface of separation container 56 that faces the outlet port of inlet pipe 15. In order to reliably suppress re-dispersion of the refrigeration oil, liquid passage section 57 may be formed over the entire circumference of the inner wall surface of separation container 56.

Furthermore, in order to efficiently guide the refrigeration oil received in groove 57*a* to oil reservoir 61, groove 57*a* formed in liquid passage section 57 is desirably formed to extend in the direction of gravity, but may be inclined slightly from the direction of gravity to such an extent that the refrigeration oil is not dispersed again by spraying of the refrigerant. Furthermore, in order to efficiently feed the refrigeration oil into oil return pipe 19, oil return pipe 19 may be disposed directly below liquid passage section 57.

Second Embodiment

Figure 7:
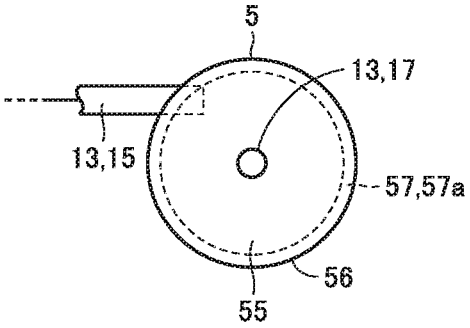
FIG. 7 is a top view of an oil separator according to the second embodiment.
Figure 8:
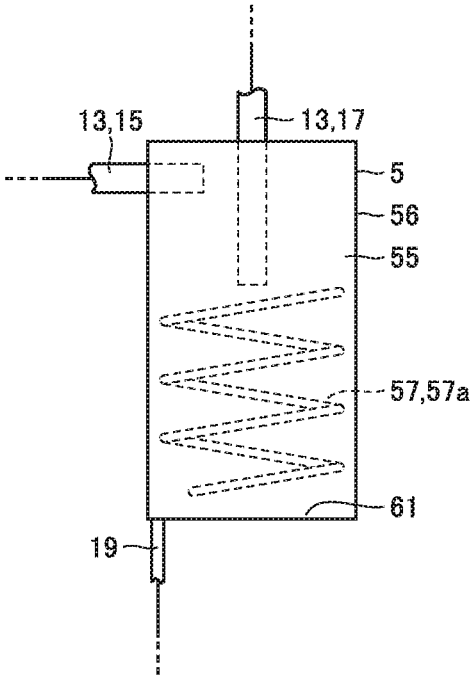
FIG. 8 is a side view of the oil separator in the second embodiment.

Oil separator 5 according to the second embodiment will be hereinafter described. As shown in FIGS. 7 and 8, oil separator 5 includes separation container 56 formed in an approximate circular cylindrical shape and forming separation chamber 55. Separation container 56 has a side surface portion to which inlet pipe 15 is attached as a part of refrigerant pipe 13. Inlet pipe 15 is attached so as to extend approximately in the tangential direction of the side surface portion of separation container 56.

Figure 9:
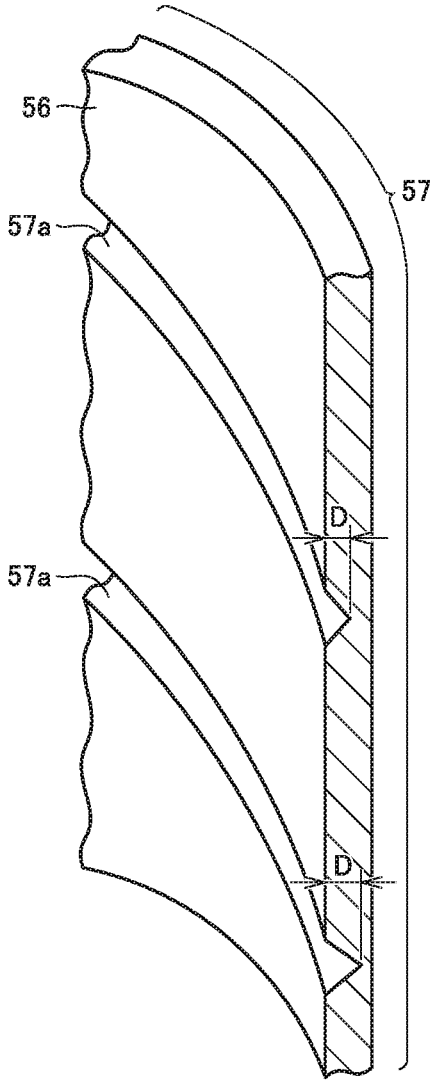
FIG. 9 is a partial enlarged perspective cross-sectional view showing a liquid passage section in the second embodiment.

As shown in FIG. 9, separation container 56 has an inner wall surface provided with liquid passage section 57. Liquid passage section 57 is provided with groove 57*a* extending in a spiral shape toward oil reservoir 61 along the inner wall surface of separation container 56. Spiral-shaped groove 57*a* is formed to have depth D that is gradually increased from the upper portion of groove 57*a* toward the lower portion thereof. In other words, spiral-shaped groove 57*a* is formed to be gradually increased in depth from the upstream side of the flow of the refrigeration oil toward the downstream side thereof.

Since the configuration other than the above is similar to that of separation container 56 shown in FIGS. 2, 3 and the like, the same components will be designated by the same reference characters, and the description thereof will not be repeated unless otherwise required.

Figure 10:
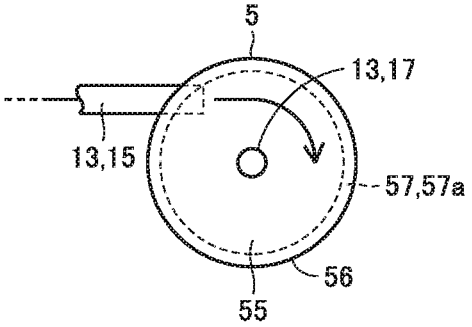
FIG. 10 is a top view of the oil separator for illustrating the operation of the oil separator in the second embodiment.
Figure 11:
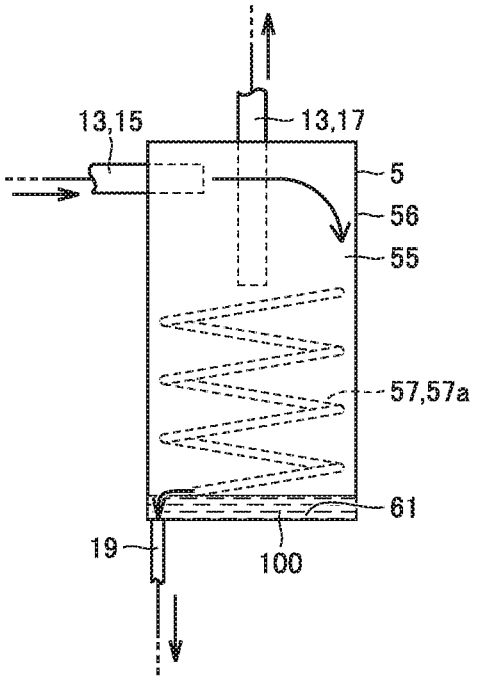
FIG. 11 is a side view of the oil separator for illustrating the operation of the oil separator in the second embodiment.

Then, the operation by the above-mentioned oil separator 5 for separating the refrigeration oil contained in the refrigerant will be described. As shown in FIGS. 10 and 11, by the operation of air conditioner 1, the high-temperature and high-pressure refrigerant discharged from compressor 3 flows through inlet pipe 15 into oil separator 5. In this case, inlet pipe 15 is attached so as to extend approximately in the tangential direction of the side surface portion of separation container 56. Thereby, while the refrigerant containing refrigeration oil flows along the inner wall surface of separation container 56 under centrifugal force, the refrigeration oil contained in the refrigerant is received in groove 57*a* of liquid passage section 57, so that the refrigerant is separated from the refrigeration oil. The refrigerant separated from the refrigeration oil flows through outlet pipe 17 as indicated by an arrow so as to be fed into condenser 7 (see FIG. 1).

On the other hand, upon reception of the flow of the refrigerant and the like discharged from inlet pipe 15, as indicated by an arrow, the refrigeration oil received in groove 57*a* flows toward oil reservoir 61 through groove 57*a* extending in a spiral shape. Refrigeration oil 100 accumulated in oil reservoir 61 flows into oil return pipe 19. As shown in FIG. 1, the refrigeration oil having flowed through oil return pipe 19 is fed into the suction side of compressor 3. Thus, the refrigeration oil discharged together with the refrigerant is returned to compressor 3. This operation is to be repeated thereafter while air conditioner 1 is operating.

In oil separator 5 of air conditioner 1 as described above, inlet pipe 15 is attached so as to extend approximately in the tangential direction of the side surface portion of separation container 56. Furthermore, groove 57*a* is formed in a spiral shape so as to extend along the flow of the refrigerant and the like that are to flow along the inner wall surface of separation container 56.

Accordingly, centrifugal force acts on the refrigerant containing the refrigeration oil flowing along the inner wall surface of separation container 56. Thus, particularly the refrigeration oil is more likely to be received in groove 57*a* of liquid passage section 57. Furthermore, the flow of the refrigerant and the like discharged from inlet pipe 15 acts on the flow of the refrigeration oil received in groove 57*a* so as to facilitate the flow of the refrigeration oil.

Furthermore, groove 57*a* is formed to be gradually increased in depth from its upper portion toward its lower portion. Thereby, similarly to the above description, the refrigeration oil is more likely to actively flow through groove 57*a* toward the lower portion of groove 57*a* at which the interfacial energy is smaller.

Thereby, the refrigeration oil received in groove 57*a* does not remain in the upper portion of groove 57*a* and is also not re-dispersed by the refrigerant and the like fed from inlet pipe 15, but flows through groove 57*a* extending in a spiral shape toward lower oil reservoir 61. As a result, the efficiency in separating the refrigeration oil contained in the refrigerant can be enhanced while the separated refrigeration oil can be reliably returned to compressor 3.

Third Embodiment

Oil separator 5 according to the third embodiment will be hereinafter described.

First Example

Figure 12:
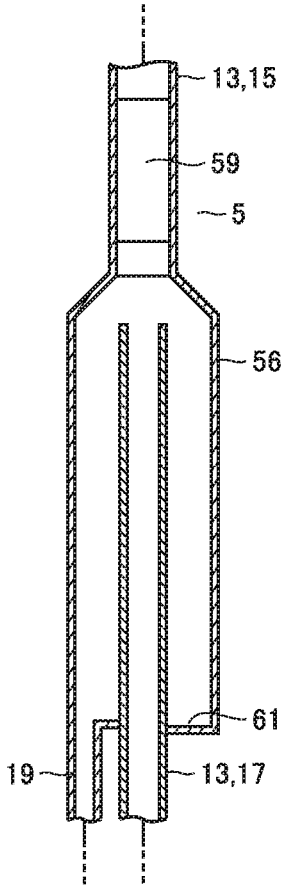
FIG. 12 is a cross-sectional view of an oil separator according to the first example in the third embodiment.

The first example will be hereinafter described. As shown in FIG. 12, oil separator 5 includes separation container 56 that forms separation chamber 55. An impeller section 59 is provided above separation container 56. Inlet pipe 15 is attached as a part of refrigerant pipe 13 to impeller section 59. Oil reservoir 61 is provided in the lower portion of separation container 56. Oil return pipe 19 is attached to oil reservoir 61.

Figure 13:
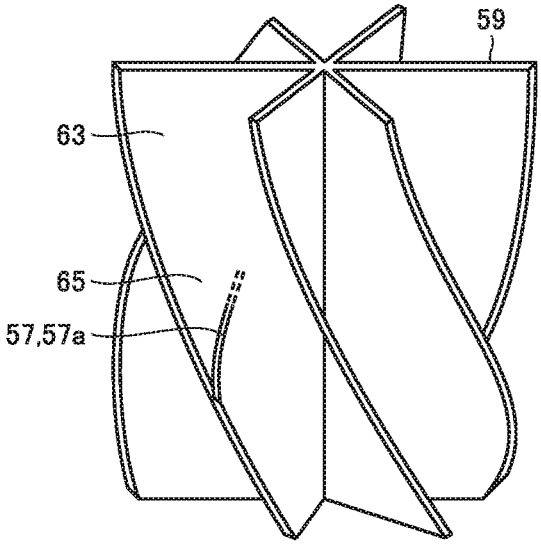
FIG. 13 is an enlarged perspective view showing an impeller section of the oil separator according to the first example in the third embodiment.

Then, impeller section 59 will be described. As shown in FIG. 13, impeller section 59 includes a vane 63 that is rotated by the flow of refrigerant and the like. Vane 63 has a vane wall surface 65 provided with liquid passage section 57. Liquid passage section 57 is provided with groove 57*a*. Groove 57*a* is formed along the flow occurring on the vane so as to extend from the rotation center side of vane 63 toward the outer circumferential end thereof.

Figure 14:
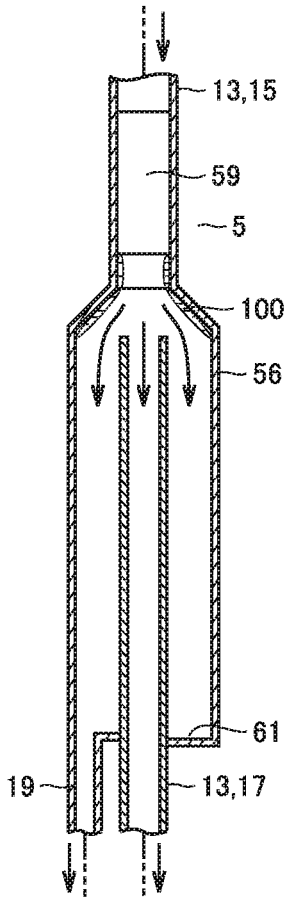
FIG. 14 is a cross-sectional view of the oil separator for illustrating the operation of the oil separator according to the first example in the third embodiment.
Figure 15:
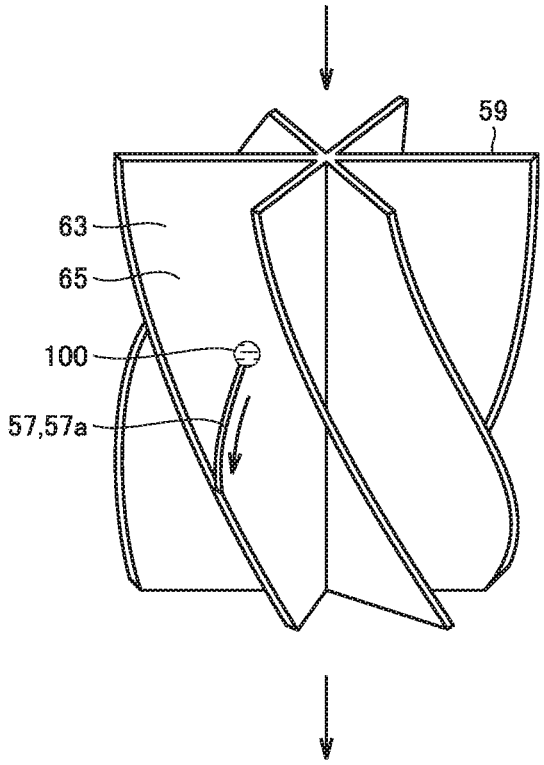
FIG. 15 is an enlarged perspective view showing an impeller section for illustrating the operation of the oil separator according to the first example in the third embodiment.

The following is an explanation about the operation by the above-mentioned oil separator 5 for separating the refrigeration oil contained in the refrigerant. As shown in FIG. 14, by the operation of air conditioner 1, the high-temperature and high-pressure refrigerant discharged from compressor 3 flows through inlet pipe 15 into oil separator 5. In this case, vane 63 of impeller section 59 is rotated by the flow of the refrigerant indicated by an arrow, as shown in FIG. 15.

When the refrigerant flows through impeller section 59, refrigeration oil 100 contained in the refrigerant collides with vane wall surface 65 of vane 63. Then, refrigeration oil 100 is received in groove 57*a* formed along the flow occurring on vane 63, so that the refrigerant is separated from the refrigeration oil. The refrigerant separated from the refrigeration oil flows through outlet pipe 17 so as to be fed into condenser 7 (see FIG. 1) as indicated by an arrow.

On the other hand, refrigeration oil 100 received in groove 57*a* flows through groove 57*a* by centrifugal force and gravity so as to reach the outer circumferential end of vane 63. The refrigeration oil having reached the outer circumferential end of vane 63 collides with the inner wall surface of separation container 56 by centrifugal force and then flows along the inner wall surface toward oil reservoir 61.

Refrigeration oil 100 accumulated in oil reservoir 61 flows into oil return pipe 19. As shown in FIG. 1, the refrigeration oil having flowed through oil return pipe 19 is fed into the suction side of compressor 3. In this way, the refrigeration oil discharged together with the refrigerant is returned to compressor 3. This operation is to be repeated thereafter while air conditioner 1 is operating.

Oil separator 5 of air conditioner 1 as described above includes impeller section 59 that is provided with vane 63 rotated by the flow of refrigerant and the like. Vane 63 has vane wall surface 65 provided with groove 57*a* along the flow occurring on vane 63. Thus, when the refrigerant and the like flow along vane wall surface 65 of vane 63, the refrigeration oil contained in the refrigerant is more likely to be received in groove 57*a*. By centrifugal force and gravity, the refrigeration oil received in groove 57*a* does not remain in a portion of groove 57*a* located on the rotation center side of vane 63, but flows toward the outer circumferential end of vane 63 and then collides with the inner wall surface of separation container 56 so as to be fed into oil reservoir 61.

This suppresses flowing of the refrigeration oil into outlet pipe 17 as a result of re-dispersion of the refrigeration oil by the refrigerant and the like fed through inlet pipe 15. Thus, the refrigeration oil can be reliably guided to oil reservoir 61. As a result, the efficiency in separating the refrigeration oil contained in the refrigerant can be enhanced while the separated refrigeration oil can be reliably returned to compressor 3.

Second Example

Figure 16:
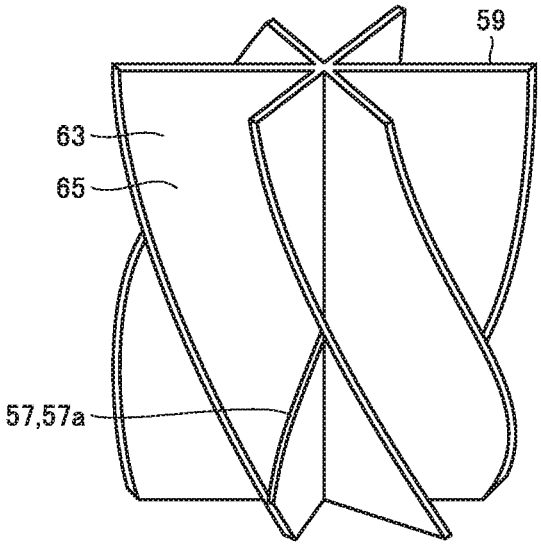
FIG. 16 is an enlarged perspective view showing an impeller section of an oil separator according to the second example in the third embodiment.
Figure 17:
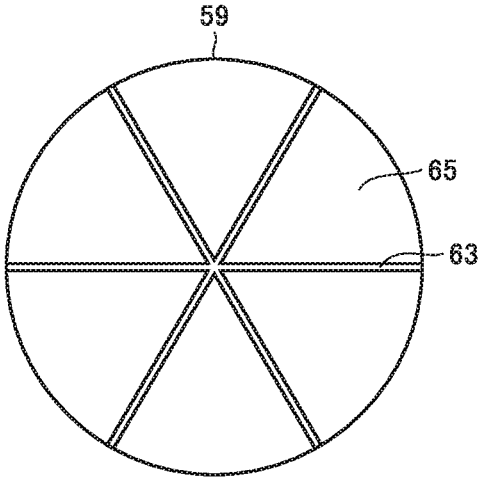
FIG. 17 is an enlarged top view showing the impeller section of the oil separator according to the second example in the third embodiment.

Then, the second example will be described. As shown in FIGS. 16 and 17, impeller section 59 includes vane 63 rotated by the flow of the refrigerant and the like. Vane 63 has vane wall surface 65 provided with liquid passage section 57. Liquid passage section 57 is provided with groove 57*a* formed to extend from the rotation center of vane 63 toward the outer circumferential end thereof. The configuration other than the above is the same as that of impeller section 59 according to the first example.

Figure 18:
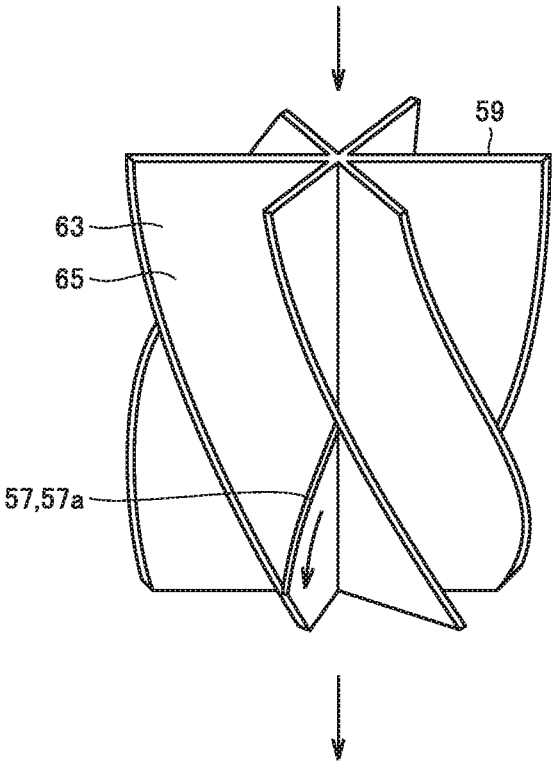
FIG. 18 is an enlarged perspective view showing the impeller section for illustrating the operation of the oil separator according to the second example in the third embodiment.

The following is an explanation about the operation by the above-mentioned oil separator 5 for separating the refrigeration oil contained in the refrigerant. By the operation of air conditioner 1, the high-temperature and high-pressure refrigerant discharged from compressor 3 flows through inlet pipe 15 into oil separator 5 (see FIG. 14). As shown in FIG. 18, inside oil separator 5, vane 63 of impeller section 59 is rotated by the flow of the refrigerant and the like as indicated by an arrow.

Figure 19:
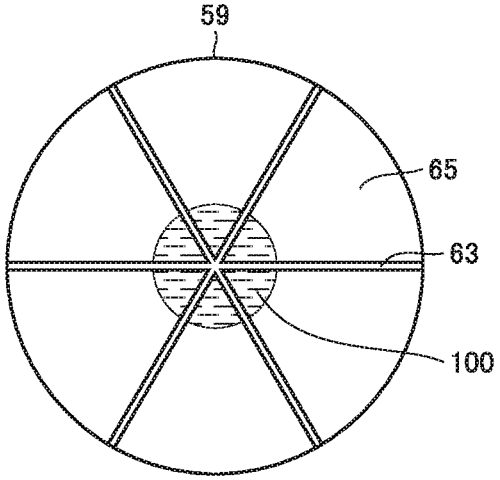
FIG. 19 is a top view showing the impeller section for illustrating the operation of the oil separator according to the second example in the third embodiment.

When the refrigerant flows through impeller section 59, the refrigeration oil contained in the refrigerant collides with vane wall surface 65 of vane 63. In the refrigeration oil that collides with vane 63, the centrifugal force acting on the refrigeration oil that collides with the rotation center and its surrounding area of vane 63 is smaller than the centrifugal force acting on the refrigeration oil that collides with the outer circumferential portion of vane 63. Thus, as shown in FIG. 19, refrigeration oil 100 having collided with the rotation center and its surrounding area of vane 63 tends to remain on vane wall surface 65.

In the above-mentioned oil separator 5, groove 57*a* is formed on vane wall surface 65 so as to extend along the flow occurring on vane 63 from the rotation center of vane 63 toward the outer circumferential portion thereof. Thus, refrigeration oil 100 receiving relatively small centrifugal force and having collided with the rotation center and its surrounding area of the vane is received in groove 57*a* and flows through groove 57*a* toward the outer circumferential end of vane 63 without remaining in the rotation center and its surrounding area of vane wall surface 65.

The refrigeration oil having reached the outer circumferential end of vane 63 collides with the inner wall surface of separation container 56 by centrifugal force and the like, and then, flows along the inner wall surface toward oil reservoir 61. Refrigeration oil 100 remaining in oil reservoir 61 flows through oil return pipe 19 so as to be fed to the suction side of compressor 3. In this way, the refrigeration oil discharged together with the refrigerant is returned to compressor 3 (see FIG. 1). This operation is to be repeated thereafter while air conditioner 1 is operating.

In oil separator 5 of air conditioner 1 as described above, vane wall surface 65 is provided with groove 57*a* that is formed to extend along the flow occurring on vane 63 from the rotation center of vane 63 toward the outer circumferential end thereof. Thus, refrigeration oil 100 receiving relatively small centrifugal force and having collided with the rotation center and its surrounding area of vane 63 is received in groove 57*a*. By centrifugal force and gravity, the received refrigeration oil does not remain in the rotation center and its surrounding area of vane wall surface 65, but flows toward the outer circumferential end of vane 63, and then collides with the inner wall surface of separation container 56 so as to be fed into oil reservoir 61.

This suppresses flowing of the refrigeration oil into outlet pipe 17 as a result of re-dispersion of the refrigeration oil by the refrigerant and the like fed through inlet pipe 15. Thus, the refrigeration oil can be reliably guided to oil reservoir 61. As a result, the efficiency in separating the refrigeration oil contained in the refrigerant can be enhanced while the separated refrigeration oil can be reliably returned to compressor 3.

Third Example

Figure 20:
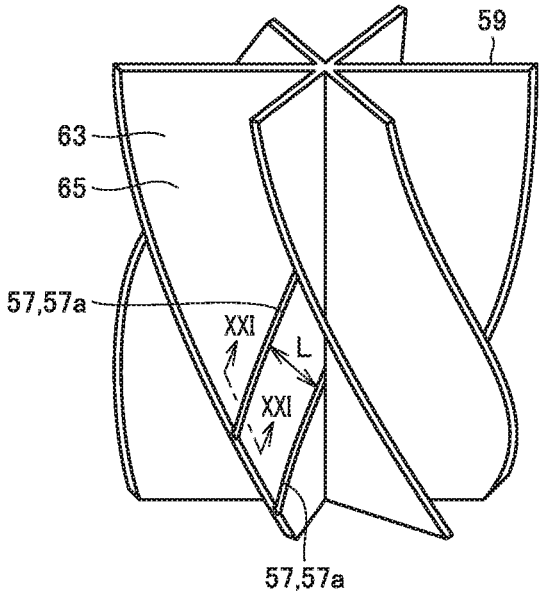
FIG. 20 is an enlarged perspective view showing an impeller section of an oil separator according to the third example in the third embodiment.

Then, the third example will be described. As shown in FIG. 20, impeller section 59 includes vane 63 that is rotated by the flow of the refrigerant and the like. Vane 63 has vane wall surface 65 provided with liquid passage section 57. Liquid passage section 57 is provided with a plurality of grooves 57*a* formed to extend from the rotation center of vane 63 toward the outer circumferential end thereof.

Figure 21:
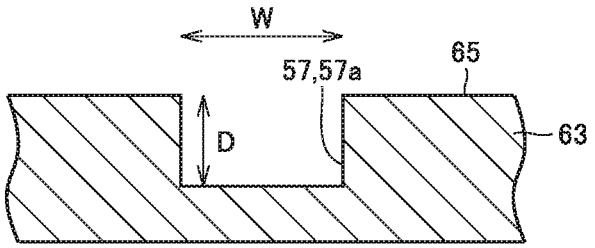
FIG. 21 is the first partial enlarged cross-sectional view taken along a cross-sectional line XXI-XXI shown in FIG. 20 in the third embodiment.
Figure 22:
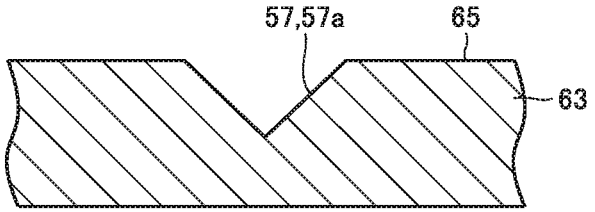
FIG. 22 is the second partial enlarged cross-sectional view taken along cross-sectional line XXI-XXI shown in FIG. 20 in the third embodiment.

For example, one groove 57*a* is separated at a distance L from another groove 57*a*. Groove 57*a* may have a rectangular cross-sectional shape having a width W and a depth D, for example, as shown in FIG. 21, or may have a V-shaped cross-sectional shape, for example, as shown in FIG. 22. The configuration other than the above is the same as that of impeller section 59 according to the second example. It should be noted that the cross-sectional shape of groove 57*a* is applicable also to oil separator 5 according to another embodiment.

Figure 23:
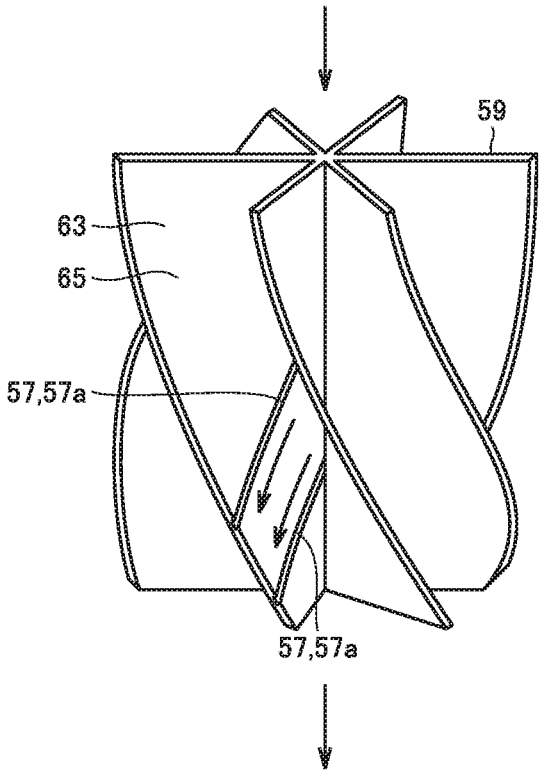
FIG. 23 is an enlarged perspective view showing the impeller section for illustrating the operation of the oil separator according to the third example in the third embodiment.
Figure 24:
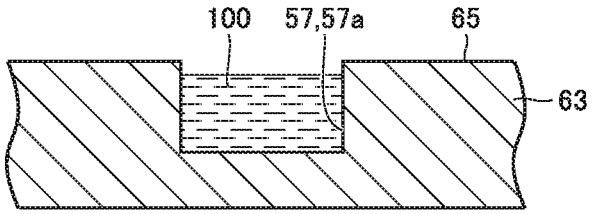
FIG. 24 is the first partial enlarged cross-sectional view for illustrating the operation of the oil separator according to the third example in the third embodiment.
Figure 25:
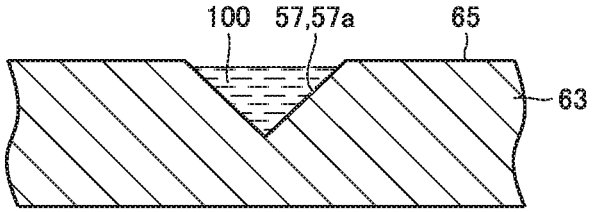
FIG. 25 is the second partial enlarged cross-sectional view for illustrating the operation of the oil separator according to the third example in the third embodiment.

The operation by the above-mentioned oil separator 5 for separating the refrigeration oil contained in the refrigerant is substantially the same as that in the case of oil separator 5 according to the second example. As shown in FIG. 23, inside oil separator 5, vane 63 of impeller section 59 is rotated by the flow of the refrigerant and the like as indicated by an arrow. Thus, refrigeration oil 100 receiving relatively small centrifugal force and having collided with the rotation center and its surrounding area of the vane is received in groove 57*a*. As shown in FIGS. 24 and 25, the received refrigeration oil 100 does not remain in the portion on the rotation center side of vane wall surface 65, but flows through groove 57*a* toward the outer circumferential end of vane 63.

By centrifugal force and the like, the refrigeration oil having reached the outer circumferential end of vane 63 collides with the inner wall surface of separation container 56. Then, the refrigeration oil flows into oil reservoir 61 and then flows through oil return pipe 19 so as to be fed to the suction side of compressor 3. In this way, the refrigeration oil discharged together with the refrigerant is returned to compressor 3 (see FIG. 1). This operation is to be repeated thereafter while air conditioner 1 is operating.

In oil separator 5 of air conditioner 1 as described above, vane wall surface 65 is provided with groove 57*a* formed to extend along the flow occurring on vane 63 from the rotation center of vane 63 toward the outer circumferential end thereof. Thus, refrigeration oil 100 receiving relatively small centrifugal force and having collided with the rotation center and its surrounding area of vane 63 is received in groove 57*a*.

Also, a plurality of such grooves 57*a* are formed. Thereby, on vane wall surface 65, the area of the refrigeration oil that is exposed to the refrigerant fed from inlet pipe 15 can be reduced. By centrifugal force and gravity, the received refrigeration oil does not remain in the portion on the rotation center side of vane wall surface 65, but flows toward the outer circumferential end of vane 63, and then, collides with the inner wall surface of separation container 56 so as to be fed into oil reservoir 61.

This suppresses flowing of the refrigeration oil into outlet pipe 17 as a result of re-dispersion of the refrigeration oil by the refrigerant and the like fed through inlet pipe 15. Thus, the refrigeration oil can be reliably guided to oil reservoir 61. As a result, the efficiency in separating the refrigeration oil contained in the refrigerant can be enhanced while the separated refrigeration oil can be reliably returned to compressor 3.

Fourth Example

Figure 26:
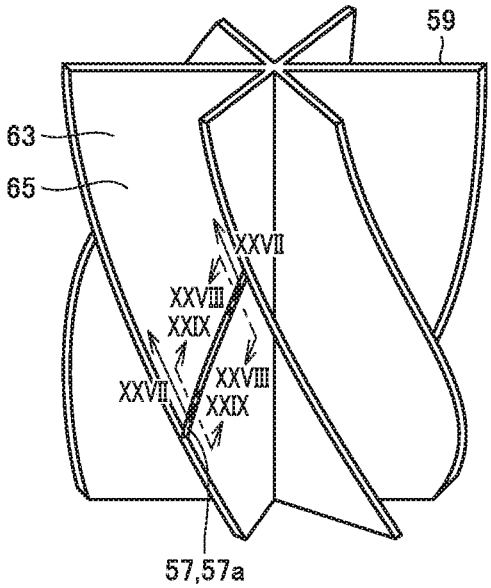
FIG. 26 is an enlarged perspective view showing an impeller section of an oil separator according to the fourth example in the third embodiment.
Figure 27:
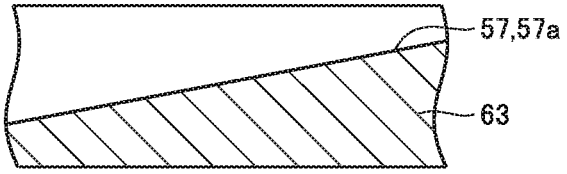
FIG. 27 is a partial enlarged cross-sectional view taken along a cross-sectional line XXVII-XXVII shown in FIG. 26 in the third embodiment.
Figure 28:
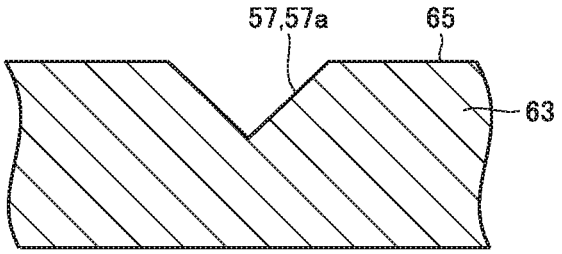
FIG. 28 is a partial enlarged cross-sectional view taken along a cross-sectional line XXVIII-XXVIII shown in FIG. 26 in the third embodiment.
Figure 29:
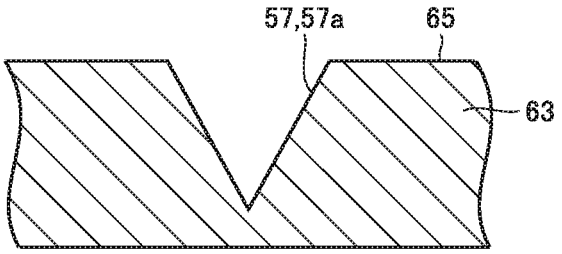
FIG. 29 is a partial enlarged cross-sectional view taken along a cross-sectional line XXIX-XXIX shown in FIG. 26 in the third embodiment.

Then, the fourth example will be described. As shown in FIG. 26, impeller section 59 includes vane 63 that is rotated by the flow of refrigerant and the like. Vane 63 has vane wall surface 65 provided with liquid passage section 57. Liquid passage section 57 is provided with groove 57*a* formed to extend from the rotation center of vane 63 toward the outer circumferential end thereof. As shown in FIGS. 27, 28 and 29, groove 57*a* is formed to be gradually increased in depth from the rotation center portion toward the outer circumferential end. The configuration other than the above is the same as that of impeller section 59 according to the second example.

Figure 30:
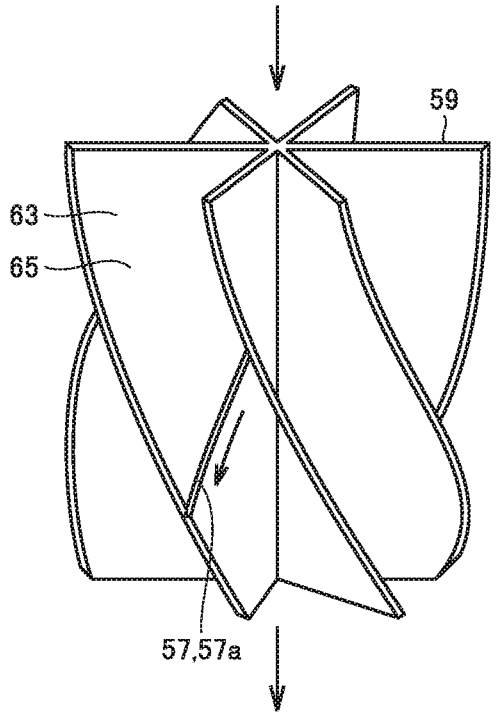
FIG. 30 is an enlarged perspective view showing the impeller section for illustrating the operation of the oil separator according to the fourth example in the third embodiment.
Figure 31:
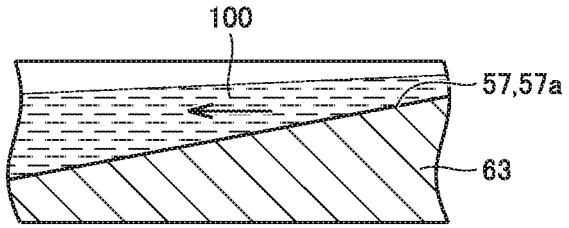
FIG. 31 is a partial enlarged cross-sectional view corresponding to FIG. 27 for illustrating the operation of the oil separator according to the fourth example in the third embodiment.
Figure 32:
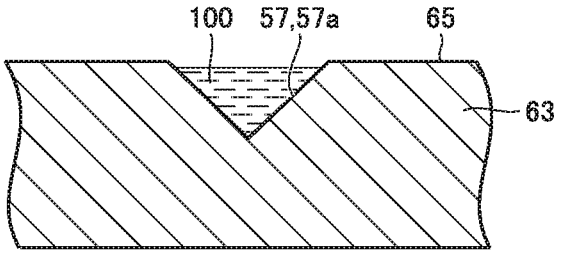
FIG. 32 is a partial enlarged cross-sectional view corresponding to FIG. 28 for illustrating the operation of the oil separator according to the fourth example in the third embodiment.
Figure 33:
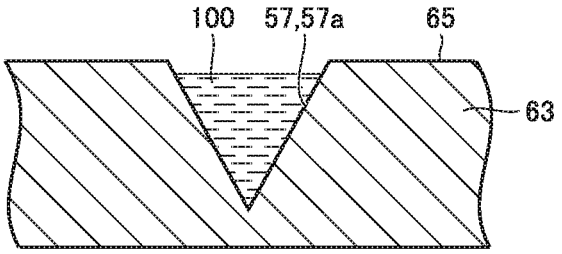
FIG. 33 is a partial enlarged cross-sectional view corresponding to FIG. 29 for illustrating the operation of the oil separator according to the fourth example in the third embodiment.

The operation by the above-mentioned oil separator 5 for separating the refrigeration oil contained in the refrigerant is substantially the same as that in the case of oil separator 5 according to the second example. As shown in FIG. 30, inside oil separator 5, vane 63 of impeller section 59 is rotated by the flow of the refrigerant and the like as indicated by an arrow. Thus, the refrigeration oil receiving relatively small centrifugal force and having collided with the rotation center and its surrounding area of the vane is received in groove 57*a*. As shown in FIGS. 31, 32 and 33, the received refrigeration oil does not remain in the portion on the rotation center side of vane wall surface 65, but flows through groove 57*a* toward the outer circumferential end of vane 63.

By centrifugal force and the like, the refrigeration oil having reached the outer circumferential end of vane 63 collides with the inner wall surface of separation container 56, and flows into oil reservoir 61, and then, flows through oil return pipe 19 so as to be fed to the suction side of compressor 3. In this way, the refrigeration oil discharged together with the refrigerant is returned to compressor 3 (see FIG. 1). This operation is to be repeated thereafter while air conditioner 1 is operating.

In oil separator 5 of air conditioner 1 as described above, vane wall surface 65 is provided with groove 57*a* formed to extend along the flow occurring on vane 63 from the rotation center of vane 63 toward the outer circumferential end thereof. Thus, refrigeration oil 100 receiving relatively small centrifugal force and having collided with the rotation center and its surrounding area of vane 63 is received in groove 57*a*.

Also, groove 57*a* is formed so as to be gradually increased in depth from the rotation center toward the outer circumferential end. Thus, the refrigeration oil is more likely to actively flow through groove 57*a* toward groove 57*a* on the outer circumferential end of vane 63 at which the interfacial energy is smaller. Furthermore, by centrifugal force and gravity, the refrigeration oil does not remain in the portion on the rotation center side of vane wall surface 65, but flows toward the outer circumferential end of vane 63, and then, collides with the inner wall surface of separation container 56 so as to be fed into oil reservoir 61.

This suppresses flowing of the refrigeration oil into outlet pipe 17 as a result of re-dispersion of the refrigeration oil by the refrigerant and the like fed through inlet pipe 15. Thus, the refrigeration oil can be reliably guided to oil reservoir 61. As a result, the efficiency in separating the refrigeration oil contained in the refrigerant can be enhanced while the separated refrigeration oil can be reliably returned to compressor 3.

Fourth Embodiment

Figure 34:
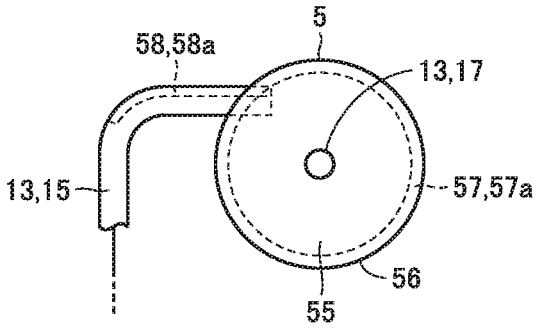
FIG. 34 is a top view of an oil separator according to the fourth embodiment.
Figure 35:
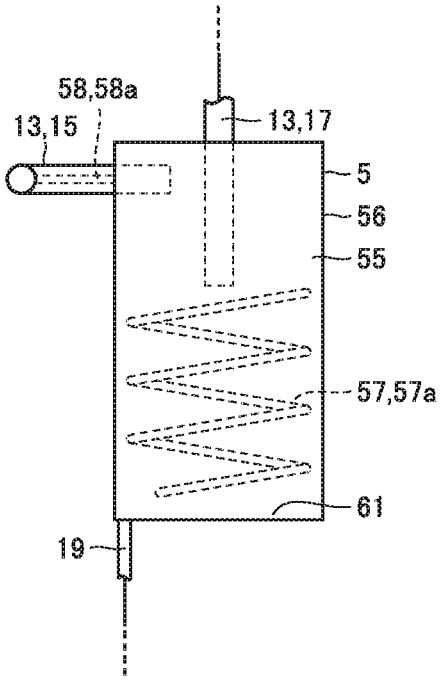
FIG. 35 is a side view of the oil separator in the fourth embodiment.

Then, oil separator 5 according to the fourth embodiment will be described. As shown in FIGS. 34 and 35, oil separator 5 includes separation container 56 that has an approximately circular cylindrical shape and that forms separation chamber 55. Separation container 56 has a side surface portion to which inlet pipe 15 is attached as a part of refrigerant pipe 13. Inlet pipe 15 is attached so as to extend approximately in the tangential direction of the side surface portion of separation container 56.

As inlet pipe 15, an L-shaped pipe bent in an L shape is used, for example. A liquid passage section 58 is provided in a portion of the inner wall surface of inlet pipe 15 that is located on the outer circumference side. Liquid passage section 58 is provided with a groove 58*a* formed to extend in the direction in which inlet pipe 15 extends. Since the configuration other than the above is similar to that of oil separator 5 shown in FIGS. 7, 8, and 9, the same components will be designated by the same reference characters, and the description thereof will not be repeated unless otherwise required.

Figure 36:
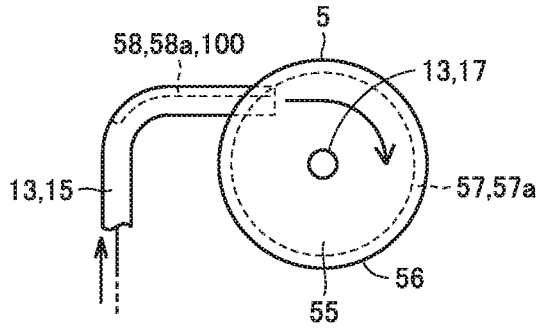
FIG. 36 is a top view of the oil separator for illustrating the operation of the oil separator in the fourth embodiment.
Figure 37:
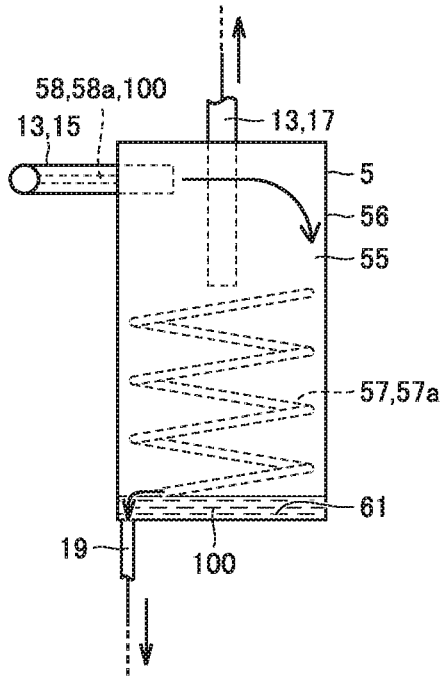
FIG. 37 is a side view of the oil separator for illustrating the operation of the oil separator in the fourth embodiment.

The following is an explanation about the operation by the above-mentioned oil separator 5 for separating the refrigeration oil contained in the refrigerant. As shown in FIGS. 36 and 37, by the operation of air conditioner 1, the high-temperature and high-pressure refrigerant discharged from compressor 3 flows through inlet pipe 15 into oil separator 5. In this case, inlet pipe 15 formed as a L-shaped pipe is provided with liquid passage section 58 that is located in a portion of the inner wall surface of inlet pipe 15 on the outer circumference side. Liquid passage section 58 is provided with groove 58*a* so as to extend in the direction in which inlet pipe 15 extends. Thereby, by centrifugal force acting when the refrigerant flows through L-shaped inlet pipe 15, the refrigeration oil contained in the refrigerant is readily received in groove 58*a* and guided to the outlet port of inlet pipe 15.

Furthermore, inlet pipe 15 is attached to separation container 56 such that the side of inlet pipe 15 provided with groove 58*a* extends approximately in the tangential direction of the side surface portion of separation container 56. Furthermore, separation container 56 has an inner wall surface provided with groove 57*a* that extends in a spiral shape toward oil reservoir 61. Thus, the refrigeration oil discharged from inlet pipe 15 is readily received in groove 57*a* of liquid passage section 57.

Upon reception of the flow of the refrigerant and the like discharged from inlet pipe 15, the refrigeration oil received in groove 57*a* flows through groove 57*a* extending in a spiral shape so as to be guided to oil reservoir 61. Refrigeration oil 100 remaining in oil reservoir 61 is fed through oil return pipe 19 to the suction side of compressor 3. In this way, the refrigeration oil discharged together with the refrigerant is returned to compressor 3. This operation is to be repeated thereafter while air conditioner 1 is operating.

In oil separator 5 of air conditioner 1 as described above, by the centrifugal force acting when the refrigerant flows through L-shaped inlet pipe 15, the refrigeration oil contained in the refrigerant is readily received in groove 58*a* so as to be guided to the outlet port of inlet pipe 15. Thereby, the variations in amount of the refrigeration oil remaining inside inlet pipe 15 are suppressed, the thickness of the refrigeration oil formed on the inner wall surface of inlet pipe 15 is reduced, and the flow velocity of the refrigerant is decreased. As a result, re-dispersion of the refrigeration oil by the refrigerant flowing through inlet pipe 15 can be suppressed.

Furthermore, inlet pipe 15 is attached to separation container 56 such that the side of inlet pipe 15 provided with groove 58*a* extends approximately in the tangential direction of the side surface portion of separation container 56. Thereby, the refrigeration oil received in groove 58*a* is readily received in groove 57*a* of liquid passage section 57 so as to be guided to oil reservoir 61. As a result, remaining of the refrigeration oil is suppressed both inside inlet pipe 15 and inside separation container 56, so that re-dispersion of the refrigeration oil can be further more effectively suppressed.

In the above-mentioned oil separator 5, L-shaped inlet pipe 15 is applied as inlet pipe 15. Inlet pipe 15 is not limited to an L-shaped inlet pipe 15, but for example may be a U-shaped pipe that is bent in a U-shape as required.

Also in the above, oil separator 5 has been described with regard to the case where L-shaped inlet pipe 15 is applied to oil separator 5 described in the second embodiment. In addition, for oil separator 5, an L-shaped inlet pipe 15 or a U-shaped inlet pipe 15 may be applied to oil separator 5 described in the third embodiment (see FIGS. 12 and 13), for example.

In this case, the refrigeration oil received in groove 58*a* formed on the inner wall surface of inlet pipe 15 is discharged from the outlet port of inlet pipe 15, so that the refrigeration oil mainly collides with the outer circumferential portion of rotating vane 63 so as to be received in groove 57*a*. Thus, as compared with the case of oil separator 5 described in the third embodiment, a relatively small amount of refrigeration oil collides with the portion on the rotation center side of vane 63 so as to be received in groove 57*a*.

Refrigeration oil 100 received in groove 57*a* as a result of collision with the outer circumferential portion of vane 63 flows through groove 57*a* under action of relatively high centrifugal force. The refrigeration oil having flowed through groove 57*a* collides with the inner wall surface of separation container 56 so as to be fed into oil reservoir 61. Thereby, the refrigeration oil received in groove 57*a* does not remain in groove 57*a*, but flows through groove 57*a*. Thus, re-dispersion of the refrigeration oil by the refrigerant and the like fed from inlet pipe 15 can be effectively suppressed.

The oil separators described in the above embodiments can be variously combined with one another as required.

The embodiments disclosed herein are illustrative and non-restrictive. The present invention is defined by the scope of the claims, rather than the scope of the description above, and is intended to include any modifications within the meaning and scope equivalent to the scope of the claims.

INDUSTRIAL APPLICABILITY

The present invention is effectively utilized in an air conditioner including an oil separator.

The invention claimed is:

1. An oil separator for separating a refrigeration oil contained in a refrigerant from the refrigerant, the oil separator comprising: a separation container forming a separation chamber; an inlet pipe of the refrigerant, the inlet pipe communicating with the separation container; an outlet pipe of the refrigerant, the outlet pipe communicating with the separation container; an oil reservoir provided in the separation container and configured to store the refrigeration oil: a liquid passage section provided with a groove, the liquid passage section being disposed inside the separation container and configured to guide the refrigeration oil contained in the refrigerant to the oil reservoir; and an oil return pipe attached to the separation container and communicating with the oil reservoir, wherein the liquid passage section has the groove that is formed to be gradually increased in depth from an upper portion of the groove toward a lower portion of the groove.

2. The oil separator according to claim 1, wherein
the liquid passage section is disposed on an inner wall surface of the separation container, and
the groove is disposed to extend in a direction of gravity toward the oil reservoir.

3. The oil separator according to claim 1, wherein
the liquid passage section is disposed on an inner wall surface of the separation container, and
the groove is disposed in a spiral shape along the inner wall surface toward the oil reservoir.

4. The oil separator according to claim 1, wherein
the inlet pipe has a bent portion, and
another liquid passage section having another groove is formed on an inner wall surface on an outer circumference side of the bent portion.

5. The oil separator according to claim 4, wherein the inlet pipe is one of an L-shaped pipe and a U-shaped pipe.

6. The oil separator according to claim 1, wherein the groove has a cross section formed in one of a V-shape and a rectangular shape.

7. An air conditioner comprising the oil separator according to claim 1, wherein
a compressor, the oil separator, a condenser, an expansion valve, and an evaporator are connected sequentially in series by a refrigerant pipe,
the refrigerant pipe has the inlet pipe and the outlet pipe,
the inlet pipe connects a discharge side of the compressor and the oil separator, the outlet pipe connects the oil separator and the condenser, and the oil return pipe connects the oil separator and a suction side of the compressor.

8. An oil separator for separating a refrigeration oil contained in a refrigerant from the refrigerant, the oil separator comprising: a separation container forming a separation chamber; an inlet pipe of the refrigerant, the inlet pipe communicating with the separation container; an outlet pipe of the refrigerant, the outlet pipe communicating with the separation container; an impeller section provided inside the separation container and having a vane configured to rotate by a flow of the refrigerant that is supplied from the inlet pipe; a liquid passage section provided in the vane and provided with a groove through which the refrigeration oil contained in the refrigerant is guided; an oil reservoir provided in the separation container and configured to store the refrigeration oil; and an oil return pipe attached to the separation container and communicating with the oil reservoir, wherein the groove is provided on a wall surface of the vane so as to extend from a rotation center side of the vane toward an outer circumferential end of the vane.

9. The oil separator according to claim 8, wherein a plurality of the grooves are provided on the wall surface at a distance from each other.

10. The oil separator according to claim 8, wherein the groove is formed to be gradually increased in depth from the rotation center side of the vane toward the outer circumferential end of the vane.

11. The oil separator according to claim 7, wherein the inlet pipe has a bent portion, and another liquid passage section having another groove is formed on an inner wall surface on an outer circumference side of the bent portion.

12. The oil separator according to claim 11, wherein the inlet pipe is one of an L-shaped pipe and a U-shaped pipe.

13. The oil separator according to claim 7, wherein the groove has a cross section formed in one of a V-shape and a rectangular shape.

14. An air conditioner comprising the oil separator according to claim 7, wherein a compressor, the oil separator, a condenser, an expansion valve, and an evaporator are connected sequentially in series by a refrigerant pipe, the refrigerant pipe has the inlet pipe and the outlet pipe, the inlet pipe connects a discharge side of the compressor and the oil separator, the outlet pipe connects the oil separator and the condenser, and the oil return pipe connects the oil separator and a suction side of the compressor.

* * * * *